US010106867B2

(12) United States Patent
Takahashi

(10) Patent No.: US 10,106,867 B2
(45) Date of Patent: Oct. 23, 2018

(54) METHOD FOR CONTINUOUSLY ANNEALING STEEL STRIP AND METHOD FOR MANUFACTURING GALVANIZED STEEL STRIP

(71) Applicant: JFE STEEL CORPORATION, Chiyoda-ku, Tokyo (JP)

(72) Inventor: Hideyuki Takahashi, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 812 days.

(21) Appl. No.: 14/405,077

(22) PCT Filed: Jun. 10, 2013

(86) PCT No.: PCT/JP2013/003634
§ 371 (c)(1),
(2) Date: Dec. 2, 2014

(87) PCT Pub. No.: WO2013/187042
PCT Pub. Date: Dec. 19, 2013

(65) Prior Publication Data

US 2015/0159235 A1 Jun. 11, 2015

(30) Foreign Application Priority Data

Jun. 13, 2012 (JP) ..... 2012-133616

(51) Int. Cl.
*C21D 9/52* (2006.01)
*C23C 2/02* (2006.01)
(Continued)

(52) U.S. Cl.
CPC ..... *C21D 9/561* (2013.01); *C21D 1/76* (2013.01); *C21D 9/52* (2013.01); *C21D 9/56* (2013.01);
(Continued)

(58) Field of Classification Search
CPC ..... C21D 9/52; C21D 9/561; C23C 2/02
(Continued)

(56) References Cited

U.S. PATENT DOCUMENTS

2009/0123651 A1 5/2009 Okada

FOREIGN PATENT DOCUMENTS

EP 1 936 000 A1 6/2008
JP 02236229 9/1990
(Continued)

OTHER PUBLICATIONS

International Search Report for International Application No. PCT/JP2013/003634 dated Aug. 27, 2013.
(Continued)

*Primary Examiner* — Brian D Walck
(74) *Attorney, Agent, or Firm* — RatnerPrestia

(57) ABSTRACT

A steel strip is annealed in a vertical annealing furnace including a heating zone and a soaking zone through which the steel strip is vertically conveyed, an atmosphere gas is supplied into the furnace to form a furnace gas that is discharged from a steel strip entrance at a lower portion of the heating zone, a part of the furnace gas is sucked and discharged into a refiner to form a gas having a lowered dew point that is returned into the furnace. A gas injector having a plurality of gas outlets arranged in a direction of a travel of the steel strip is disposed to suppress a mixing of an atmosphere in the furnace upstream of the gas injector and an atmosphere in the furnace downstream of the gas injector, and a temperature of the steel strip passing through the gas injector is controlled to 600° C. to 700° C.

16 Claims, 2 Drawing Sheets

(51) Int. Cl.

| | |
|---|---|
| ***C21D 9/56*** | (2006.01) |
| ***C21D 1/76*** | (2006.01) |
| ***C23C 2/06*** | (2006.01) |
| ***C23C 2/40*** | (2006.01) |
| ***C22C 38/06*** | (2006.01) |
| ***C22C 38/02*** | (2006.01) |
| ***C22C 38/04*** | (2006.01) |

(52) U.S. Cl.
CPC ..... *C22C 38/02* (2013.01); *C22C 38/04* (2013.01); *C22C 38/06* (2013.01); *C23C 2/02* (2013.01); *C23C 2/06* (2013.01); *C23C 2/40* (2013.01)

(58) Field of Classification Search
USPC ..... 148/533, 579
See application file for complete search history.

(56) References Cited

FOREIGN PATENT DOCUMENTS

| | | | |
|---|---|---|---|
| JP | 04318121 | | 11/1992 |
| JP | 0718339 | | 1/1995 |
| JP | 2567130 | | 12/1996 |
| JP | 2567140 | | 12/1996 |
| JP | 09324210 | | 12/1997 |
| JP | H09324209 | A | 12/1997 |
| JP | 10176225 | | 6/1998 |
| JP | 2000290762 | | 10/2000 |
| JP | 2003129125 | | 5/2003 |
| JP | 2007146241 | | 6/2007 |
| JP | 2011-046988 | A | 3/2011 |
| JP | 2012072451 | | 4/2012 |
| WO | 2007043273 | | 4/2007 |

OTHER PUBLICATIONS

European Office Action for European Application No. 13804997.8, dated Nov. 2, 2016, 3 pages.
Japanese Office Action for Japanese Application No. 2013-543075, dated Feb. 4, 2014, including Concise Statement of Relevance of Office Action, 5 pages.
Chinese Office Action dated Apr. 18, 2016 for Application No. 201380031150.2, including Concise Statement of Relevance, 14 pages.
Korean Notice of Allowance dated May 1, 2016 for Application No. 10-2014-7035449, including English translation, 3 pages.
Supplementary European Search Report for Application No. EP 13 80 4997 dated Jun. 17, 2015.

METHOD FOR CONTINUOUSLY ANNEALING STEEL STRIP AND METHOD FOR MANUFACTURING GALVANIZED STEEL STRIP

CROSS REFERENCE TO RELATED APPLICATIONS

This is the U.S. National Phase application of PCT/JP2013/003634, filed Jun. 10, 2013, which claims priority to Japanese Patent Application No. 2012-133616, filed Jun. 13, 2012, the disclosures of each of these applications being incorporated herein by reference in their entireties for all purposes.

FIELD OF THE INVENTION

The present invention relates to a method for continuously annealing a steel strip and a method for manufacturing a galvanized steel strip.

BACKGROUND OF THE INVENTION

In recent years, the demand for high-strength steel (high-tensile steel) capable of contributing to weight reduction of structures and the like has been growing in the field of automobiles, home appliances, and building materials. The technology of high-tensile steel may possibly be capable of manufacturing a high-strength steel strip with good stretch flangeability by adding Si to steel and suggests the possibility that a steel strip with good ductility can be provided because retained γ is likely to be formed when Si or Al is contained.

However, when a high-strength cold-rolled steel strip contains easily oxidizable elements such as Si and Mn, there are problems such as poor surface appearance and failure in chemical conversion treatability such as phosphate treatment because the easily oxidizable elements are enriched on surfaces of the steel strip during annealing and therefore oxides of Si, Mn, and the like are formed.

For galvanized steel strips, when a steel strip contains easily oxidizable elements such as Si and Mn, there is a problem in that the wettability is impaired and plating defects are caused because the easily oxidizable elements are enriched on surfaces of the steel strip during annealing and therefore oxides of Si, Mn, and the like are formed. Furthermore, there is a problem in that the alloying rate is reduced during alloying subsequent to plating. In particular, Si significantly reduces the wettability between the steel strip and a plating metal if oxide films of $SiO_2$ are formed on surfaces of the steel strip. Furthermore, the $SiO_2$ oxide films act as barriers to the diffusion of a base metal and a plating metal during alloying. Therefore, Si is likely to particularly cause problems such as impairments in wettability and alloying treatability.

A potential way to avoid the problem is to control the oxygen potential in an annealing atmosphere.

For example, Patent Literature 1 discloses a method for increasing the oxygen potential in such a way that the dew point of a region from the rear end of a heating zone to an soaking zone is controlled to a high dew point of −30° C. or higher. This method has the advantage that the method produces some effect and it is industrially easy to adjust the dew point to the high dew point. However, the method has a disadvantage that it is not easy to manufacture the type of steel which is unsuitable for operation at a high dew points (for example, Ti-IF steel). This is because it takes a very long time to change the annealing atmosphere from a high dew point to a low dew point. Furthermore, the method produces an oxidizing furnace atmosphere, and incorrect operation results in pick-up defects due to the deposition of an oxides on rollers in the furnace or damage to furnace wall.

Another potential way is to control the oxygen potential to be low. However, since Si, Mn, and the like are very oxidizable, it is very difficult to stably create an atmosphere having a low dew point of −40° C. or lower which is excellent in suppressing the oxidation of Si, Mn, and the like in such a large-size continuous annealing furnace in a CGL (continuous galvanizing line) or a CAL (continuous annealing line).

For example, Patent Literatures 2 and 3 disclose techniques for efficiently achieving an annealing atmosphere with a low dew point. These techniques are applied to relatively small-size furnaces such as one-path vertical furnaces and do not take into account that a steel strip containing an easily oxidizable element such as Si or Mn is annealed in a multi-path vertical annealing furnace such as a CGL or a CAL.

PATENT LITERATURE

PTL 1: WO 2007/043273
PTL 2: Japanese Patent No. 2567140
PTL 3: Japanese Patent No. 2567130

SUMMARY OF THE INVENTION

The present invention provides a method for continuously annealing a steel strip. The method has less of a problem with the occurrence of pick-up defects or a problem with the damage of furnace walls; prevents easily oxidizable elements, such as Si and Mn, in steel from being enriched on surfaces of a steel strip to prevent the formation of oxides of the easily oxidizable elements, such as Si and Mn; and can form an annealing atmosphere having a low dew point which is suitable for annealing a steel strip containing a easily oxidizable element such as Si or Mn. Furthermore, the present invention also provides a method for manufacturing a galvanized steel strip by performing galvanizing after the annealing of a steel strip using the continuous annealing method.

In order to efficiently reduce the dew point of a large-size annealing furnace, a source of moisture needs to be identified. As a result of intensive investigations, the inventor has found that it is very important to take measures against moisture generated by the reduction of native oxides on a steel strip. As a result of further investigations, the inventor has achieved findings (i) and (ii) below to complete the present invention as described below.

(i) The temperature at which reduction occurs is 500° C. to 600° C.

(ii) Oxidation of easily oxidizable elements such as Si and Mn, and surface enrichment (a factor impairing platability, such as an ungalvanized surface) occurs at 700° C. or higher.

Means, according to aspects of the present invention, for solving the above problems are as described below.

(1) A method for continuously annealing a steel strip which includes annealing the steel strip in a vertical annealing furnace having a heating zone and soaking zone through which the steel strip is vertically conveyed. An atmosphere gas is supplied from an outside of the furnace into the furnace to form a furnace gas that is discharged from a steel strip entrance at a lower portion of the heating zone. A part of the furnace gas is sucked and discharged into a refiner that is disposed outside of the furnace and includes a deoxygenator and a dehumidifier such that oxygen and moisture in the part of the furnace gas are removed to form a gas having a lowered dew point, and the gas having the lowered dew point is returned to the furnace.

The method further includes disposing a gas injector having a plurality of gas outlets arranged in a direction of a travel of the steel strip within a space spanning from the heating zone to the soaking zone such that a mixing of an atmosphere in the furnace upstream of the gas injector and an atmosphere in the furnace downstream of the gas injector is suppressed, and controlling a temperature of the steel strip passing through the gas injector between 600° C. to 700° C.

(2) A method for continuously annealing a steel strip which includes annealing the steel strip in a vertical annealing furnace having a heating zone and soaking zone through which the steel strip is vertically conveyed. An atmosphere gas is supplied from outside of the furnace into the furnace to form a furnace gas that is discharged from a steel strip entrance at a lower portion of the heating zone. A part of the furnace gas is sucked and discharged into a refiner that is disposed outside of the furnace and includes a deoxygenator and a dehumidifier such that oxygen and moisture in the part of the furnace gas are removed to form a gas having a lowered dew, and the gas having the lowered dew point is returned into the furnace.

The method further includes disposing a gas injector having a plurality of gas outlets arranges in a direction of a travel of the steel strip within a space spanning from the heating zone to the soaking zone such that a mixing of an atmosphere in the furnace upstream of the gas injector and an atmosphere in the furnace downstream of the gas injector is suppressed, controlling a temperature of the steel strip passing through the gas injector between 550° C. to 700° C., and adjusting, within the part of the furnace gas discharged into the refiner, an amount of the furnace gas downstream of the gas injector larger than an amount of the furnace gas upstream of the gas injector.

(3) A method for manufacturing a galvanized steel strip includes annealing a steel strip by the continuous annealing method specified in Item (1), and galvanizing the annealed steel strip.

(4) A method for manufacturing a galvanized steel strip includes annealing a steel strip by the continuous annealing method specified in Item (2), and galvanizing the annealed steel strip.

According to the present invention, an annealing atmosphere having a low dew point which is suitable for annealing a steel strip containing an easily oxidizable element such as Si or Mn can be achieved at low cost in such a way that the mixing of an atmosphere in a temperature range where a reduction reaction proceeds and an atmosphere in a temperature range where surface enrichment proceeds is suppressed by providing a gas injector having a plurality of gas outlets arranged in the direction of travel of the steel strip. The present invention can improve platability in hot-dip galvanizing of a steel strip which contains an easily oxidizable element such as Si or Mn.

DETAILED DESCRIPTION OF EMBODIMENTS OF THE INVENTION

Figure 1:
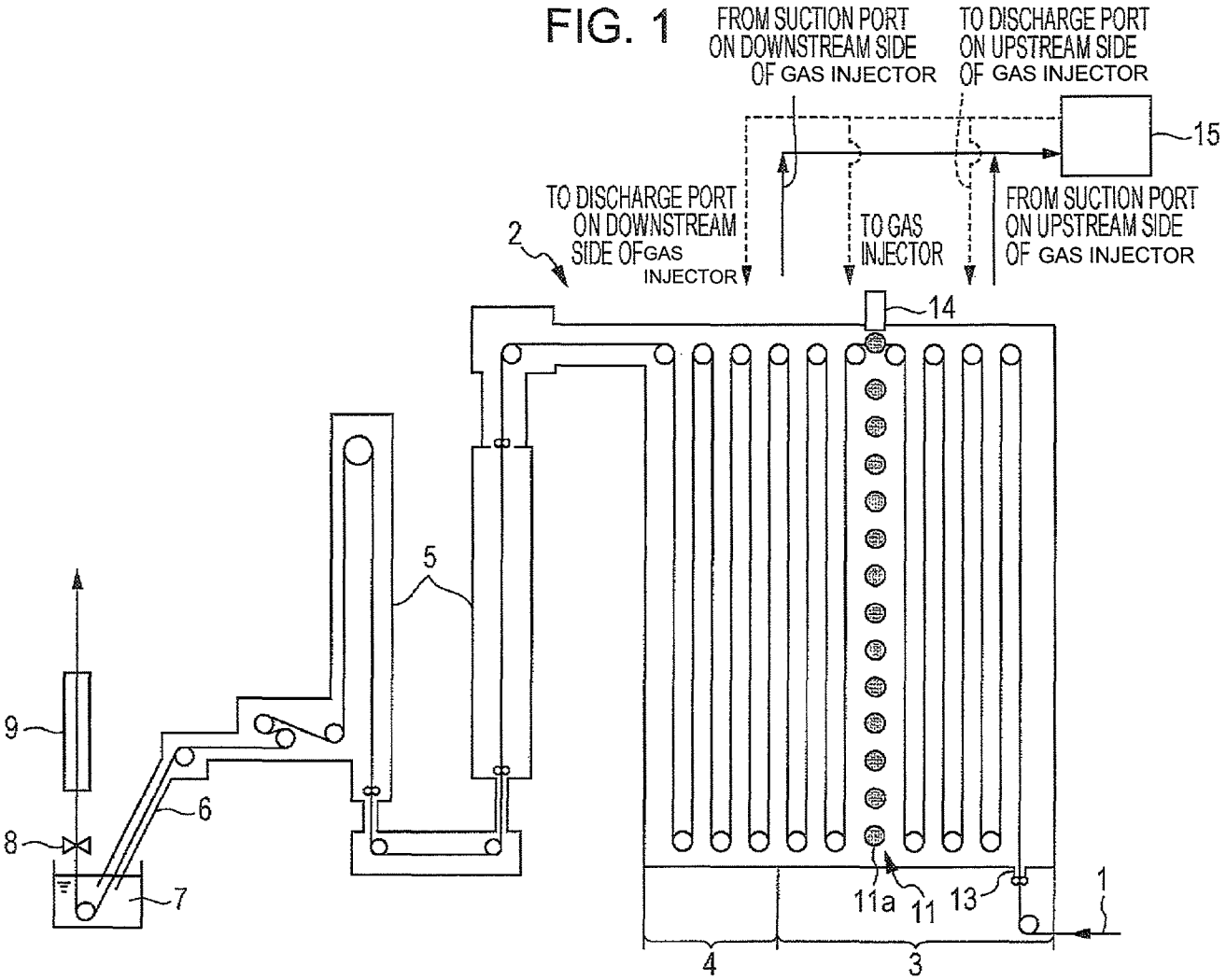
FIG. 1 shows an example of the configuration of a continuous galvanizing line for steel strips, including a vertical annealing furnace used to carry out the present invention.

In order to efficiently reduce the dew point of an annealing furnace in a continuous annealing line for steel strips or a continuous galvanizing line for steel strips, it is very important to identify a source of water, which causes an increase in dew point. The inventor has continuously measured dew points at multiple points in an actual annealing furnace to find that the water source is present in a region where the temperature of a steel strip is 500° C. to 600° C. According to laboratory experiments, this temperature region is one in which the reduction of an oxide film proceeds most quickly. Therefore, the present inventor recognized that the reduction of native oxides on a steel strip is largely responsible for the high dew point in this range.

On the other hand, the surface enrichment level of an easily oxidizable element, which significantly affects platability, increases with an increase in steel strip temperature or dew point and the degree of influence thereof varies significantly depending on an element contained in a steel strip. Concerning, for example, Mn or Si, which is known as a typical example of elements used in high-tensile steel, laboratory experiments have indicated that the surface enrichment of Mn or Si proceeds at a steel strip temperature of 800° C. or higher or 700° C. or higher, respectively.

As described above, the generation of water by reduction occurs mostly within the range of 500° C. to 600° C. and the surface enrichment of a Si series or a Mn series is problematic at a temperature of 700° C. or higher or 800° C. or higher, respectively, when the dew point is high. From such a fact, the inventor has reached a conclusion that an atmosphere suitable for ensuring platability is readily obtained by suppressing a mixing of an atmosphere in a temperature range where a reduction reaction proceeds and an atmosphere in a temperature range where surface enrichment proceeds. That is, in the case where a gas injector is provided and the temperature of a steel strip passing in front of the gas injector is adjusted to at least 600° C. to 700° C., most of moisture generated by the reduction of native oxides can be confined in a low-temperature range upstream of the gas injector which has no influence on platability. Therefore, the dew point of an atmosphere in a high-temperature range downstream of the gas injector in which the surface enrichment of an easily oxidizable element may possibly proceed can be maintained low at low cost in such a way that the gas injector is provided and the temperature of the steel strip passing in front of the gas injector is adjusted to at least 600° C. to 700° C.

When the temperature of the steel strip passing in front of the gas injector is higher than 700° C., a reduction reaction has completed upstream of this position. For the Si series, it is the temperature range where surface enrichment may possibly affect wettability. Therefore, it is important to reduce the dew point of the low temperature-side atmosphere upstream of the gas injector. In this case, water is not generated by the reduction reaction in the high-temperature region downstream of the gas injector and therefore the temperature control can be made relatively easily.

However, when the temperature of the steel strip passing in front of the gas injector is lower than 600° C., reduction does not complete on the low-temperature side upstream of the gas injector and proceeds on the high-temperature side downstream thereof. Therefore, it is important to reduce the dew point of the high temperature-side atmosphere. The dew point of the high temperature-side atmosphere can be reduced in such a way that, within a furnace gas discharged into a refiner, an amount of the furnace gas downstream of the gas injector is adjusted to be larger than an amount of the furnace gas upstream of the gas injector. However, when the temperature of the steel strip passing in front of the gas injector is lower than 550° C., the reduction of the dew point in the furnace downstream of the gas injector is insufficient even if the amount of the furnace gas downstream of the gas injector is controlled to be larger than the amount of the furnace gas upstream of the gas injector.

There are two methods for suppressing the mixing of atmospheres: one is to physically suppress the mixing of the atmospheres using a partition made of bricks or the like and the other is to non-physically suppress the mixing of the atmospheres by gas sealing or the like. However, providing an additional partition in an existing furnace needs a long period to remove moisture from heat insulating bricks or for construction. Therefore, it is preferred to use a method for suppressing the mixing of the atmospheres by a non-contact process such as gas sealing.

In an annealing furnace equipped with a refiner which is disposed outside of the furnace and which includes a deoxygenator and a dehumidifier, an atmosphere with a lower dew point can be achieved by combining a suppression of mixing of atmospheres by a non-contact process such as gas sealing, a discharge of gas into the refiner, and a discharge of gas from the refiner.

Figure 2:
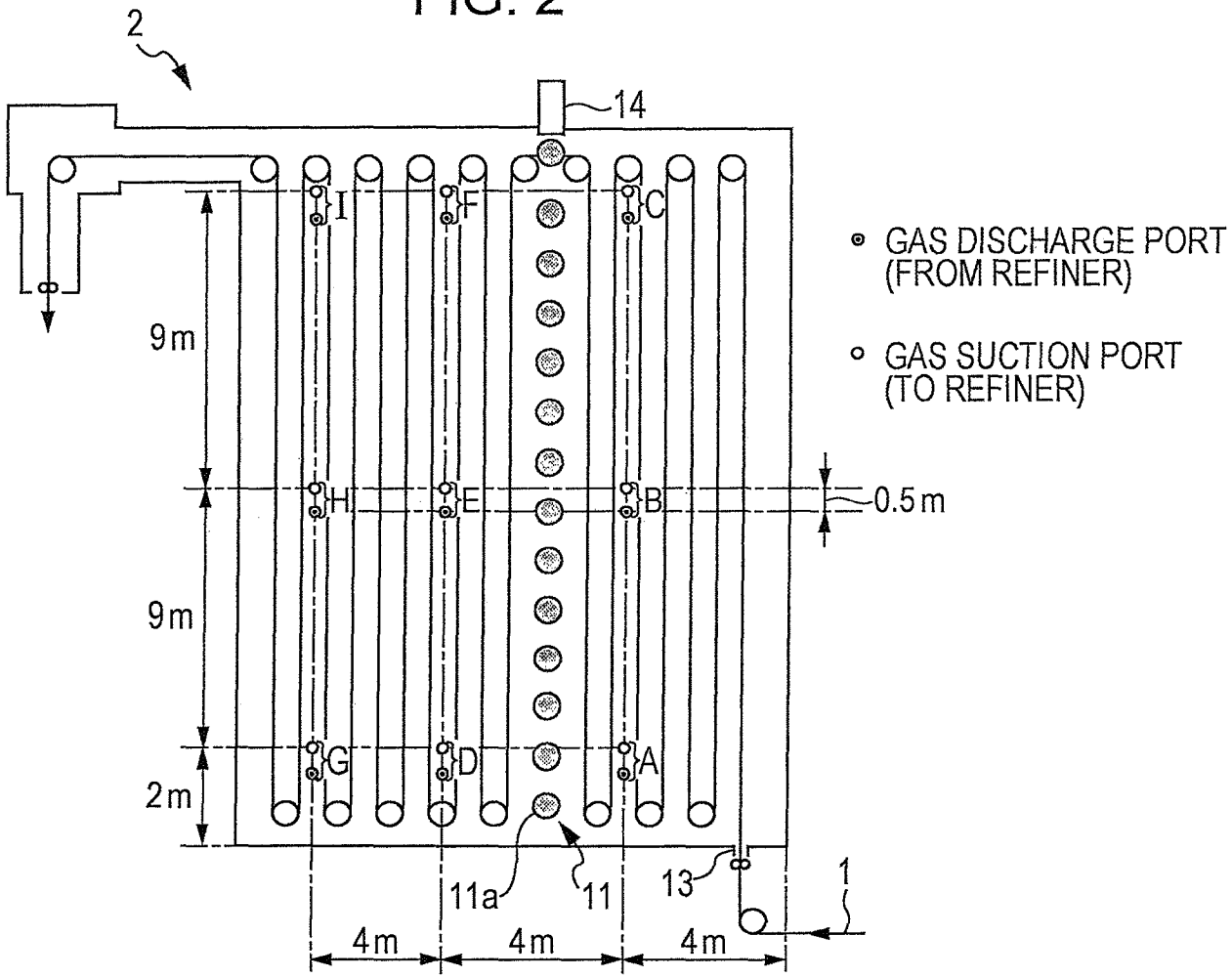
FIG. 2 shows an example of the arrangement of gas suction ports going to a refiner and gas discharge ports coming from the refiner disposed in a heating zone and in a soaking zone of an annealing furnace.

FIG. 1 shows an example of the configuration of a continuous galvanizing line, including a vertical annealing furnace used to carry out the present invention, for steel strips. FIG. 2 shows an example of the arrangement of gas suction (vents) ports going to a refiner and outlets of gas coming from the refiner disposed in a heating zone and in a soaking zone of the annealing furnace. Embodiments of the present invention are described below with reference to FIGS. 1 and 2.

As shown in FIG. 1, the continuous galvanizing line includes a multi-path vertical annealing furnace 2 upstream of a plating bath 7. In usual, a heating zone 3, a soaking zone 4, and a cooling zone 5 are arranged in the annealing furnace 2 in that order from the upstream side to the downstream side of the furnace. A gas injector 11 having a plurality of outlets 11*a* that arranged in the direction of a travel of a steel strip and discharge gas is disposed within a space spanning from the heating zone 3 to the soaking zone 4. The discharge direction of the gas is not particularly limited. Incidentally, the discharge direction of the gas is preferably horizontal because the effect of suppressing the mixing of atmospheres in the furnace is large. The gas injector 11 suppresses the mixing of the furnace atmosphere upstream of the gas injector 11 and the furnace atmosphere downstream of the gas injector 11.

The outlets 11*a* discharge gas over an entire width of the furnace in a width direction of the furnace. The width direction of the furnace coincides with a width direction of the steel strip. The number of the outlets 11*a* is preferably large. However, the outlets 11*a* are preferably arranged at an interval of at least 4 m or less in the direction of travel of the steel strip. The flow rate at each outlet is preferably 25 $Nm^3$/hr or more. When the intervals in the direction of travel of the steel strip is more than 4 m or the flow rate at each outlet is less than 25 $Nm^3$/hr, the suppression of the mixing of the atmospheres may possibly be insufficient. Discharge gas may include the gas discharged from the refiner of the furnace, gas with a dew point lower than the dew point in the furnace to be set such as an $N_2$ gas with a dew point of −60° C.

The steel strip passes above the gas injector 11. Reference numeral 14 represents a thermometer that measures the temperature of the steel strip passing in front of the gas injector 11.

The annealing furnace 2 is connected to the plating bath 7 through a snout 6. The inside of the furnace that ranges from the heating zone 3 to the snout 6 is maintained in a reducing atmosphere gas or a non-oxidizing atmosphere. The heating zone 3 and the soaking zone 4 indirectly heat the steel strip 1 using radiant tubes (RTs) acting as heating means.

The reducing atmosphere gas used is usually an $H_2$—$N_2$ gas and is introduced into an appropriate site of the inside of the furnace that ranges from the heating zone 3 to the snout 6. The gas introduced into the furnace is discharged from the entry side of the furnace except inevitable portions such as furnace leaks. The gas in the furnace flows from the downstream side to the upstream side of the furnace against the direction of travel of the steel strip and is discharged outside of the furnace through an opening 13 located on the entry side of the furnace.

A location where the steel strip 1 passes in front of the gas injector 11 is preferably positioned away from the opening 13 located on the entry side of the furnace through which the gas in the furnace is discharged as far as possible. In the annealing furnace shown in FIG. 1, the location where the steel strip 1 passes in front of the gas injector 11 is positioned furthest away from the opening 13, which is located on the entry side of the furnace.

In order to lower the dew point of an atmosphere gas in the furnace, the refiner 15 is disposed outside of the furnace. The refiner 15 includes a deoxygenator and a dehumidifier and is configured such that a part of the atmosphere gas in the furnace is discharged to the refiner 15, the dew point is reduced by removing oxygen and moisture from the gas and the gas with a lowered dew point is discharged into the furnace. The refiner may be a known one.

The gas suction ports going to the refiner and the gas discharge ports coming from the refiner are arranged in appropriate positions upstream and downstream of the gas injector 11, which is disposed within a space spanning from the heating zone to the soaking zone.

Referring to FIG. 2, the gas suction ports going to the refiner are arranged in the heating zone so as to be placed in three different sites in the height direction of the furnace and are arranged at six different sites in the soaking zone so as to be placed in the length direction and in the height direction of the furnace. The length direction of the furnace is a horizontal direction in FIG. 2. Each of the gas discharge ports coming from the refiner is placed 0.5 m below corresponding one of the suction ports. The amount of gas sucked from each of the suction ports and the amount of gas discharged from each of the discharge ports can be individually adjusted in terms of flow rates.

When the steel strip is annealed in the annealing furnace, the control of the temperature of the steel strip passing in front of the gas injector 11 is very important. As described above, the temperature at which reduction proceeds is 500° C. to 600° C. and the temperature at which surface enrichment proceeds is 700° C. or higher or 800° C. or higher in the case of the Si or Mn series, respectively. Since the temperature at which reduction proceeds and the temperature at which surface enrichment proceeds are close to each other, effects of the present invention are not exhibited and opposite effects may possibly be caused if temperature control is not adequate.

In a first embodiment of the present invention, the temperature of the steel strip passing in front of the gas injector 11 is controlled within the range of 600° C. to 700° C. When the temperature of the steel strip is lower than 600° C., the steel strip is conveyed to a high-temperature side downstream of the gas injector in an insufficiently reduced state. Therefore, a large amount of gas due to reduction is generated on the high-temperature side and the dew point on the high-temperature side is increased, thereby impairing the wettability. In contrast, when the temperature of the steel strip is higher than 700° C., surface enrichment proceeds on a low-temperature side upstream of the gas injector 11 having a high dew point, and the platability is impaired. The temperature of the steel strip passing in front of the gas injector 11 can be controlled by adjusting the heating capacity, the burning capacity, or the like of the RTs.

When the temperature of the steel strip passing in front of the gas injector 11 is within the range of 600° C. to 700° C., the platability of a Si- or Mn-containing steel strip can be enhanced without using the refiner. Furthermore, the use of the refiner enables the dew point of gas in the furnace to be reduced and also enables the platability to be enhanced.

The gas going to the refiner may be discharged from the low-temperature side upstream of the gas injector 11 or the high-temperature side downstream of the gas injector 11. Incidentally, the gas going to the refiner is preferably discharged such that the amount of gas discharged from downstream of the gas injector 11 is larger than the amount of gas discharged from upstream of the gas injector 11. In this case, when the temperature of the steel strip passing in front of the gas injector 11 is within the range of 600° C. to 700° C. or even when the temperature thereof is within a range wider than the above range on a low-temperature side, that is, the range of, for example, 550° C. to 700° C., effects of the present invention can be achieved.

That is, in a second embodiment of the present invention, the temperature of the steel strip passing in front of the gas injector 11 is controlled within the range of 550° C. to 700° C. and the gas going to the refiner is discharged such that the amount of gas discharged from downstream of the gas injector 11 is larger than the amount of gas discharged from upstream of the gas injector 11.

The steel strip is annealed in the heating zone 3 and the soaking zone 4 in a predetermined manner, is cooled in the cooling zone 5, is immersed in the plating bath 7 through the snout 6, and is thereby galvanized and the coating weight is adjusted to a predetermined coating weight with wiping nozzles 8, whereby a galvanized steel strip is obtained. After the coating weight is adjusted with the wiping nozzles 8, a zinc coating is alloyed using a heater 9.

The steel strip annealed by a method according to the present invention can be enhanced in platability by galvanizing because the surface enrichment of easily oxidizable elements such as Si and Mn is suppressed. Effects of the present invention are exhibited, for example, when the steel strip contains 0.4% to 2.0% by mass of Si and/or 1% to 3% by mass of Mn. In addition to Si and/or Mn, C, Al, S, P, and the like are contained. The content of each typical component is as follows: the content of C is 0.01% to 0.18%, the content of Al is 0.001% to 1.0%, the content of P is 0.005% to 0.060%, and the content of S is 0.01% or less on a mass basis. In order to control the balance between the strength and the ductility, at least one selected from the group consisting of 0.001% to 0.005% of B, 0.005% to 0.05% of Nb, 0.005% to 0.05% of Ti, 0.001% to 1.0% of Cr, 0.05% to 1.0% of Mo, 0.05% to 1.0% of Cu, and 0.05% to 1.0% of Ni may be added as required.

In the above-mentioned annealing furnace, the steel strip is introduced from a lower portion of the furnace. However, the steel strip may be introduced from the upper side of the furnace. In the annealing furnace described above, the steel strip travels above the gas injector 11. However, the steel strip may travel under the gas injector 11. In the annealing furnace described above, the soaking zone and the heating zone communicate with each other through an upper portion of the furnace. However, the soaking zone and the heating zone may communicate with each other through a lower portion of the furnace. In the annealing furnace described above, no preheater is placed upstream of the heating zone. However, the annealing furnace may include a preheater.

An annealing method according to the present invention can be applied to an annealing method used in a continuous annealing line (CAL) for steel strips.

Examples

Steel strips were galvanized in an ART (all-radiant tube) CGL including a gas injector that is disposed within a space spanning from a heating zone and a soaking zone to suppress the mixing of an atmosphere in the furnace and a refiner that is disposed outside of the furnace and includes a dehumidifier and a deoxygenator as shown in FIGS. 1 and 2 in such a way that atmosphere conditions in the furnace were varied and the dew points were measured, whereby galvanized steel strips were manufactured and the platabilities were evaluated.

The length (the horizontal length in FIG. 2) from the heating zone to the soaking zone was 16 m. The length of the heating zone was 6 m. The length of the soaking zone was 10 m. The gas injector was located 6 m apart from an entry-side wall of the furnace. A refiner gas (a dew point of −60° C., 500° C., a dehumidified furnace gas) was discharged from the gas injector (φ 50 mm outlets arranged in 14 sites at intervals of 1.4 m in the direction of travel of the steel strips). Sites for supplying an atmosphere gas from outside of the furnace were arranged in the soaking zone in nine positions at each of 1 m above a drive-side hearth and 10 m above the drive-side hearth along the length direction of the furnace and totaled 18. The supplied atmosphere gas had a dew point of −60° C. to −70° C. and was an $H_2$—$N_2$ gas (an $H_2$ concentration of 10% by volume).

Gas suction ports going to the refiner and gas discharge ports coming from the refiner were as shown in FIG. 2. The coordinates (the distance from the entry-side wall of the furnace, the distance from the bottom of the furnace) of suction ports A to I of the atmosphere gas shown in FIG. 2 were as follows: A=(4 m, 2 m), B=(4 m, 11 m), C=(4 m, 20 m), D=(8 m, 2 m), E=(8 m, 11 m), F=(8 m, 20 m), G=(12 m, 2 m), H=(12 m, 11 m), and I=(12 m, 20 m). Discharge ports A to I were located 0.5 m down from the suction ports A to I (suction/discharge from one side wall of the furnace). The gas suction ports going to the refiner were φ 200 mm and the discharge ports were φ 50 mm. Other specifications such as flow rate were as shown in Table 2. In the refiner, the dehumidifier contained a synthetic zeolite and the deoxygenator contained a palladium catalyst.

Cold-rolled steel strips (three types of steels A to C shown in Table 1) having a thickness of 0.8 mm to 1.2 mm and a width of 950 mm to 1,000 mm were used and were tested under conditions as common as possible such that the annealing temperature was 820° C. and the feed rate was 100 mpm to 120 mpm.

TABLE 1

Table 1

(mass percent)

| | C | Si | Mn | S | Al | P |
|---|---|---|---|---|---|---|
| Steel A | 0.12 | 0.1 | 2.3 | 0.003 | 0.03 | 0.01 |
| Steel B | 0.12 | 0.5 | 1.7 | 0.003 | 0.03 | 0.01 |
| Steel C | 0.12 | 1.3 | 2.0 | 0.003 | 0.03 | 0.01 |

On the basis (−34° C. to −36° C.) of the dew point (initial dew point) of an atmosphere obtained without using the refiner, the dew point was investigated after the refiner was used for 1 hr. The dew points were measured at the same position as those of gas suction ports (however, on the side of the furnace wall opposite to the suction port).

Evaluation standards of platability (plating quality) are as described below.

A: Acceptable (a beautiful surface and an outer panel level of quality)

B: Acceptable (an inner panel level of quality)

C: Slightly defective and within an acceptable range (bare spots and the like)

D: Seriously defective (large bare spots) and unacceptable

Results are shown in Table 2.

TABLE 2

| No. | Dew point A ° C. | B ° C. | C ° C. | D ° C. | E ° C. | F ° C. | G ° C. | H ° C. | I ° C. | Temperature of steel strip above gas injector ° C. | Flow rate Suction port A Nm³/hr | Suction port B Nm³/hr |
|---|---|---|---|---|---|---|---|---|---|---|---|---|
| 1 | −34.9 | −34.1 | −33.8 | −35.0 | −34.6 | −34.0 | −36.0 | −35.4 | −35.4 | — | 0 | 0 |
| 2 | −45.4 | −47.6 | −47.9 | −50.8 | −49.9 | −48.7 | −51.1 | −50.7 | −49.2 | 800 | 400 | 300 |
| 3 | −42.1 | −43.4 | −44.8 | −51.6 | −50.9 | −50.1 | −51.7 | −51.2 | −50.4 | 800 | 0 | 0 |
| 4 | −45.6 | −47.7 | −48.7 | −50.8 | −50.1 | −49.1 | −50.8 | −50.2 | −49.7 | 750 | 400 | 300 |
| 5 | −42.2 | −43.6 | −45.2 | −51.5 | −50.8 | −50.3 | −51.5 | −51.0 | −50.2 | 750 | 0 | 0 |
| 6 | −46.4 | −47.9 | −49.3 | −50.2 | −49.6 | −49.3 | −50.7 | −49.7 | −49:6 | 700 | 400 | 300 |
| 7 | −42.2 | −43.6 | −45.4 | −51.5 | −50.8 | −50.3 | −51.6 | −51.0 | −50.2 | 700 | 0 | 0 |
| 8 | −47.2 | −48.7 | −49.9 | −50.3 | −49.7 | −49.4 | −50.6 | −49.9 | −49.7 | 650 | 400 | 300 |
| 9 | −42.3 | −43.5 | −45.5 | −51.4 | −50.7 | −50.2 | −51.5 | −50.9 | −50.3 | 650 | 0 | 0 |
| 10 | −48.0 | −49.2 | −50.1 | −50.1 | −49.6 | −49.3 | −50.4 | −49.7 | −49.5 | 600 | 400 | 300 |
| 11 | −43.2 | −44.1 | −45.9 | −51.1 | −50.7 | −50.3 | −51.4 | −51.0 | −50.4 | 600 | 0 | 0 |
| 12 | −50.2 | −50.9 | −51.2 | −46.3 | −44.7 | −44.8 | −46.6 | −45.1 | −46.1 | 550 | 400 | 300 |
| 13 | −45.6 | −45.9 | −46.3 | −50.6 | −50.2 | −49.3 | −50.9 | −50.3 | −49.8 | 550 | 0 | 0 |
| 14 | −50.1 | −50.7 | −50.3 | −43.3 | −43.0 | −42.7 | −43.6 | −43.1 | −43.3 | 500 | 400 | 300 |
| 15 | −48.4 | −48.9 | −48.9 | −49.4 | −48.6 | −48.2 | −50.0 | −49.2 | −49.0 | 500 | 0 | 0 |
| 16 | −50.1 | −50.2 | −49.8 | −42.9 | −42.5 | −42.4 | −43.1 | −42.6 | −43.0 | 450 | 400 | 300 |
| 17 | −48.8 | −49.5 | −49.8 | −49.1 | −48.2 | −47.8 | −49.3 | −48.4 | −48.0 | 450 | 0 | 0 |

| No. | Flow rate Suction port C Nm³/hr | Suction port D | Suction port E | Suction port F | Rate of gas discharged from gas injector | Plating quality Steel A | Steel B | Steel C | Remarks |
|---|---|---|---|---|---|---|---|---|---|
| 1 | 0 | 0 | 0 | 0 | 0 | D | D | D | Comparative example |
| 2 | 300 | 0 | 0 | 0 | 1000 | A | C | D | Comparative example |
| 3 | 0 | 300 | 300 | 400 | 1000 | A | D | D | Comparative example |
| 4 | 300 | 0 | 0 | 0 | 1000 | A | A | C | Comparative example |
| 5 | 0 | 300 | 300 | 400 | 1000 | A | A | D | Comparative example |
| 6 | 300 | 0 | 0 | 0 | 1000 | A | A | B | Inventive example |
| 7 | 0 | 300 | 300 | 400 | 1000 | A | A | A | Inventive example |
| 8 | 300 | 0 | 0 | 0 | 1000 | A | A | B | Inventive example |
| 9 | 0 | 300 | 300 | 400 | 1000 | A | A | A | Inventive example |
| 10 | 300 | 0 | 0 | 0 | 1000 | A | A | B | Inventive example |
| 11 | 0 | 300 | 300 | 400 | 1000 | A | A | A | Inventive example |
| 12 | 300 | 0 | 0 | 0 | 1000 | B | D | D | Comparative example |
| 13 | 0 | 300 | 300 | 400 | 1000 | A | A | B | Inventive example |
| 14 | 300 | 0 | 0 | 0 | 1000 | C | D | D | Comparative example |
| 15 | 0 | 300 | 300 | 400 | 1000 | A | A | C | Comparative example |
| 16 | 300 | 0 | 0 | 0 | 1000 | C | D | D | Comparative example |
| 17 | 0 | 300 | 300 | 400 | 1000 | A | B | D | Comparative example |

It is clear that examples of the present invention have a lower dew point as compared to comparative examples and are improved in platability.

According to the present invention, an annealing atmosphere having a low dew point which is suitable for annealing a steel strip containing an easily oxidizable element such as Si or Mn can be achieved at low cost in such a way that the mixing of an atmosphere in a temperature range where a reduction reaction proceeds and an atmosphere in a temperature range where surface enrichment proceeds is suppressed by providing a gas injector having a plurality of gas discharge ports arranged in the direction of travel of the steel strip. According to the present invention, the platability of a steel strip which contains an easily oxidizable element such as Si or Mn and which is galvanized can be improved.

REFERENCE SIGNS LIST

1 Steel strip
2 Annealing furnace
3 Heating zone
4 Soaking zone
5 Cooling zone
6 Snout
7 Plating bath
8 Wiping nozzles
9 Heater
11 Gas injector
11*a* Outlets
13 Opening
14 Thermometer
15 Refiner

The invention claimed is:

1. A method for continuously annealing a steel strip, the method comprising:

annealing the steel strip in a vertical annealing furnace including a heating zone and a soaking zone arranged in this order from an entry side of the furnace through which the steel strip is conveyed in a vertical direction, an atmosphere gas being supplied from an outside of the furnace into the furnace to form a furnace gas that is discharged from a steel strip entrance at the entry side of the furnace, a part of the furnace gas being sucked and discharged Into a refiner that is disposed outside of the furnace and includes a deoxygenator and a dehumidifier such that oxygen and moisture in the part of the furnace gas are removed to form a refiner gas having a lowered dew point, and the refiner gas with the lowered dew point being returned into the furnace;

disposing a gas injector for discharging gas over an entire width of the furnace, the gas injector having a plurality of gas outlets oriented to discharge gas into the furnace in a direction parallel to a width of the steel strip, the plurality of gas outlets arranged at an interval of 4 m or less in the vertical direction within the heating zone such that a mixing of the furnace gas upstream of the gas injector nearer to the steel strip entrance and the furnace gas downstream of the gas injector farther from the steel strip entrance is suppressed; and controlling a temperature of the steel strip passing through the gas injector between 600° C. and 700° C.

2. A method for continuously annealing a steel strip, the method comprising:

annealing the steel strip in a vertical annealing furnace including a heating zone and a soaking zone arranged in this order from an entry side of the furnace through which the steel strip is conveyed in a vertical direction, an atmosphere gas being supplied from an outside of the furnace into the furnace to form a furnace gas that is discharged from a steel strip entrance at the entry side of the furnace, a part of the furnace gas being sucked and discharged into a refiner that is disposed outside of the furnace and Includes a deoxygenator and a dehumidifier such that oxygen and moisture in the part of the furnace gas are removed to form a refiner gas having a lowered dew point, and the refiner gas having the lowered dew point being returned into the furnace;

disposing a gas injector for discharging gas over an entire width of the furnace, the gas injector having a plurality of gas outlets oriented to discharge gas into the furnace in a direction parallel to a width of the steel strip, the plurality of as outlets arranged at an interval of 4 m or less in the vertical direction within the heating zone such that a mixing of the furnace gas upstream of the gas injector nearer to the steel strip entrance and the furnace gas downstream of the gas injector farther from the steel strip entrance is suppressed;

controlling a temperature of the steel strip passing through the gas injector between 550° C. to 700° C.; and adjusting, within the part of the furnace gas discharged into the refiner, an amount of the furnace gas downstream of the gas injector larger than an amount of the furnace gas upstream of the gas injector.

3. The method according to claim 1, further comprising galvanizing the annealed steel strip.

4. The method according to claim 2, further comprising galvanizing the annealed steel strip.

5. The method according to claim 1, wherein the gas outlets of the gas injector inject the refiner gas with the lowered dew point.

6. The method according to claim 1, wherein the steel strip includes at least one of Si or Mn and the steel strip is heated in the downstream of the gas injector in a temperature range of 700° C. or higher.

7. The method according to claim 5, wherein the steel strip includes at least one of Si or Mn and the steel strip is heated in the downstream of the gas injector in a temperature range of 700° C. or higher.

8. The method according to claim 2, wherein the gas outlets of the gas injector inject the refiner gas with the lowered dew point.

9. The method according to claim 2, wherein the steel strip includes at least one of Si or Mn and the steel strip is heated in the downstream of the gas injector in a temperature range of 700° C. or higher.

10. The method according to claim 8, wherein the steel strip includes at least one of Si or Mn and the steel strip is heated in the downstream of the gas Injector in a temperature range of 700° C. or higher.

11. The method according to claim 1, wherein a flow rate at each of the plurality of gas outlets is 25 $Nm^3$/hr or more.

12. The method according to claim 2, wherein a flow rate at each of the plurality of gas outlets is 25 $Nm^3$/hr or more.

13. A method for continuously annealing a steel strip, the method comprising:

annealing the steel strip in a vertical annealing furnace including a heating zone and a soaking zone arranged in this order from an entry side of the furnace through which the steel strip is conveyed in a vertical direction, an atmosphere gas being supplied from an outside of the furnace into the furnace to form a furnace gas that is discharged from a steel strip entrance at the entry side of the furnace;

disposing a gas injector for discharging gas over an entire width of the furnace, the gas injector having a plurality of gas outlets oriented to discharge gas into the furnace in a direction parallel to a width of the steel strip, the plurality of gas outlets arranged at an interval of 4 m or less in the vertical direction within the heating zone such that a mixing of the furnace gas upstream of the gas injector nearer to the steel strip entrance and the furnace gas downstream of the gas injector farther from the steel strip entrance is suppressed; and controlling a temperature of the steel strip passing through the gas injector between 600° C. and 700° C.

14. The method according to claim 13, wherein the steel strip includes at least one of Si or Mn and the steel strip is heated in the downstream side of the gas injector in a temperature range of 700° C. or higher.

15. The method according to claim 13, further comprising galvanizing the annealed steel strip.

16. The method according to claim 13, wherein a flow rate at each of the plurality of gas outlets is 25 $Nm^3/hr$ or more.

* * * * *